United States Patent [19]

Yarlovsky

[11] 4,310,030

[45] Jan. 12, 1982

[54] HAND-HELD WEAVER'S REED AND METHOD OF USE

[76] Inventor: Milka G. Yarlovsky, 13635 Grenoble Dr., Rockville, Md. 20853

[21] Appl. No.: 139,471

[22] Filed: Apr. 11, 1980

[51] Int. Cl.[3] ..... D03D 29/00

[52] U.S. Cl. ..... 139/29

[58] Field of Search ..... 139/1 R, 1 F, 188, 29, 139/30, 34, 192; 28/149, 151, 152; 19/115 R

[56] References Cited

U.S. PATENT DOCUMENTS

| | | | |
|---|---|---|---|
| 1,320,997 | 11/1919 | Turner | 139/188 |
| 1,449,686 | 3/1923 | Mace | 139/192 |
| 1,455,537 | 5/1923 | Lindsay | 139/192 |
| 1,483,495 | 2/1924 | Vishloff | 19/115 R |
| 1,970,443 | 8/1934 | Cooper et al. | 139/192 |
| 2,150,187 | 3/1939 | Raba et al. | 139/33 |
| 2,404,708 | 7/1946 | Hertel | 19/115 R |
| 2,771,909 | 11/1956 | Ulrich | 139/188 |

*Primary Examiner*—Henry Jaudon

*Attorney, Agent, or Firm*—Schuyler, Banner, Birch, McKie & Beckett

[57] ABSTRACT

A hand-held weaver's reed and the method of using it to beat up filling yarns against the fell of a woven fabric. The reed has a plurality of spaced, substantially parallel teeth and a handle which extends transversely of the width of the reed and transversely of the direction in which the teeth project.

11 Claims, 3 Drawing Figures

HAND-HELD WEAVER'S REED AND METHOD OF USE

BACKGROUND OF THE INVENTION

1. Field of the Invention

The present invention relates to textile weaving and, more particularly, to a hand-held weaver's reed and the method of using it to beat up filling yarns against the fell of a hand-woven fabric.

2. Description of the Prior Art

Textile weaving is an ancient art. In early times as well as now, a large number of warp threads or yarns are supported on a loom at spaced locations across the width of the fabric to be woven. Alternate warp yarns are held at one end in one "harness", and the remaining alternate yarns are held in a second harness. One harness is movable with respect to the other so that alternate yarns may be raised or lowered to create an opening or "shed" between alternate yarns through which a shuttle passes carrying a weft yarn. Alternating movement of the harnesses between passes of the shuttle creates a woven fabric wherein each weft yarn passes over and under alternate warp yarns.

Other types of yarns may also be joined to the warp yarns. In the ancient art of oriental rug weaving, pile yarns are manually tied or otherwise joined to the warp yarns according to a certain scheme. For example, two weft yarns may be interwoven with the warp yarns, and then individual pile yarns may be tied to adjacent pairs of warp yarns using a particular knot. Two more weft yarns may then be interwoven before the next row of pile yarns is tied. Other schemes may also be used. In woven fabrics in general, yarns which are interwoven with or joined to the warp yarns are collectively known as "filling" yarns. When the fabric is an oriental rug, the filling yarns include the weft yarns and the pile yarns.

In order to weave a relatively dense fabric, the filling yarns must be compressed tightly against the already woven portion of the fabric. This is accomplished by using a comb-like structure or "reed" having teeth or "dents" which are spaced apart so as to fit between adjacent warp yarns. The teeth of the reed are urged against the filling yarns to compress them against the woven portion of the fabric. This process is known as "beating up" the filling yarns against the "fell" of the fabric.

Manual combs used now or in early times for this purpose are generally straight, flat, large and rather cumbersome, having teeth made of wood, bone or horn. Such flat combs are often difficult to pick up when they are lying on a flat surface. A long comb is particularly difficult to use in that both of the weaver's hands are required to manipulate it, and it must be carefully positioned with respect to the warp yarns to insure that the warp yarns are properly engaged by the teeth. Because of the frictional contact between the large number of teeth and the warp yarns, substantial effort is required to compress the filling yarns against the fell of the fabric. This problem is especially pronounced in weaving oriental rugs, in that there are many pile yarns incorporated into the woven structure which must be densely packed together with the weft yarns to produce a high quality rug.

The weaving of hand-made oriental rugs has recently become a popular hobby and pastime for persons of all ages. Prior art hand-held reeds or combs are not well-suited for weaving such a product, however, especially where the weaver is a young child whose size and strength are in sufficient to enable him to comfortably and effectively handle a comb of this type.

SUMMARY OF THE INVENTION

Accordingly, it is an object of the present invention to obviate the above noted disadvantages of the prior art by providing a simple, compact and easily manipulated hand-held weaver's reed for beating up filling yarns against the fell of a woven fabric.

Another object of the invention is to provide such a weaver's reed having teeth which can easily be inserted between the warp yarns of the fabric to be woven.

Another object of the invention is to provide such a weaver's reed which can be held in and manipulated by a single hand.

Another object of the invention is to provide such a weaver's reed which can easily be picked up from rest on a flat surface.

Another object of the invention is to provide such a weaver's reed which can easily be driven against the fell of the fabric to produce the compacting force required to properly beat up the filling yarns.

Another object of the invention is to provide such a weaver's reed which is especially well-suited for use in weaving oriental rugs.

These and other objects of the present invention are accomplished by providing a hand-held weaver's reed for beating up filling yarns against the fell of a woven fabric, the reed having teeth support means, a plurality of spaced, side-by-side, substantially parallel teeth secured to and projecting from the support means across the width of the support means, the spacing of the teeth approximating the spacing of the warp yarns of the fabric so that the teeth can be inserted between adjacent warp yarns to compress the filling yarns, and a handle secured to the support means and having an elongated grip portion which extends transversely of the width of the support means and transversely of the direction in which the teeth project from the support means. A method of using this reed to beat up the filling yarns against the fell of the fabric also is provided.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DETAILED DESCRIPTION OF THE INVENTION

Figure 1:
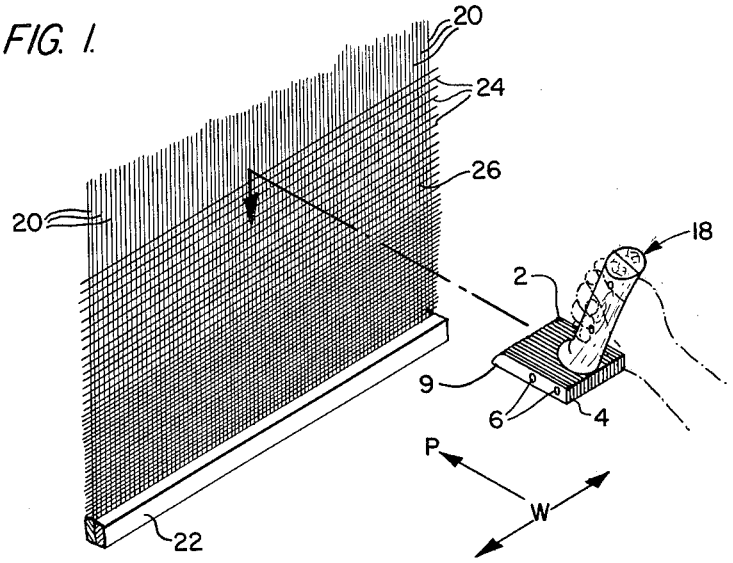
FIG. 1 is a perspective view showing the weaver's reed of the invention in use in beating up the filling yarns against the fell of the fabric.
Figure 3:
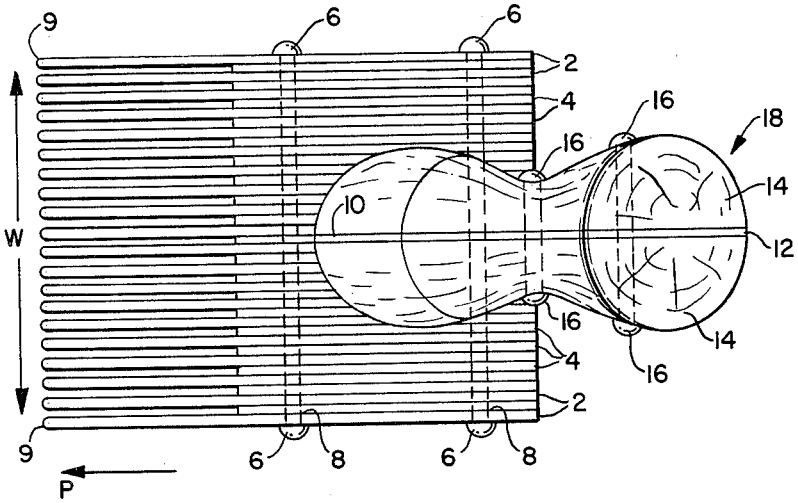
FIG. 3 is a top plan view of the same.

Referring to the figures, the weaver's reed according to the invention comprises a plurality of substantially parallel teeth or dents 2 which are separated by spacers 4 extending along a portion of the length of each tooth 2. Teeth 2 and spacers 4 are secured together by elongated, headed rivets 6 which extend across the width of the reed through aligned holes 8 in teeth 2 and spacers 4 to bind the teeth and spacers into a laminated structure. Bolts may be used in place of rivets 6. In the preferred embodiment illustrated in the figures, twenty teeth 2 and nineteen spacers 4 are provided.

Figure 2:
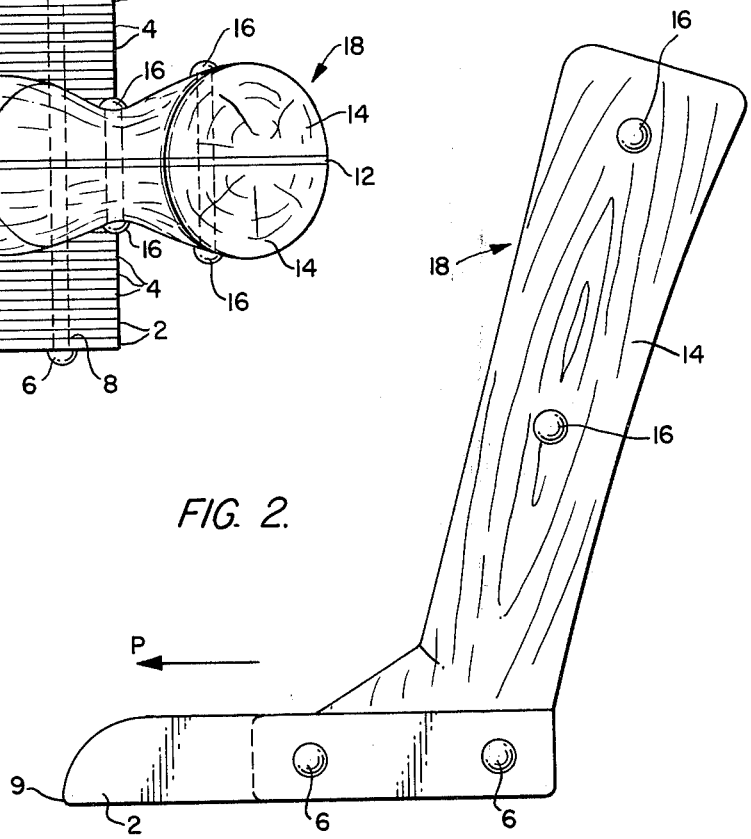
FIG. 2 is a side elevational view of the weaver's reed of the invention.

Teeth 2 may flare slightly outwardly while remaining substantially parallel and properly spaced to fit between the warp yarns of the fabric to be woven. To facilitate their insertion between the warp threads, the tips 9 of teeth 2 are arcuately tapered, as shown in FIG. 2, and their edges are slightly rounded.

The central spacer 10 is provided with an extension 12 which extends transversely of the width W of the reed and transversely of the direction P in which the teeth 2 project. Contoured grip portions 14 are secured to extension 12 by rivets 16 to form a handle 18. The flat bottoms of teeth 2 and spacers 4 support the reed on a table or other flat surface with handle 18 projecting upwardly for easy grasping by the weaver.

Teeth 2 and spacers 4 and 10 may be made of steel. Grip portions 14 may be made of wood. Teeth 2 are approximately 3¼ inches long, while spacers 4 are approximately 2 inches long, leaving approximately 1¼ inch of each tooth projecting beyond the spacers 4. Teeth 2 and spacers 4 are approximately 1/16 inch thick by ⅝ inch high. The radius of curvature of the tip 9 of each tooth is approximately ½ inch. Handle 18 is approximately 4½ inches in length and 1¼ inch in mean diameter. The preferred weight of the reed is approximately 1 pound, but a reed weighing anywhere between ½ pound and two pounds would function well for its intended purpose. Handle 18 preferably extends at a slight angle back from a plane perpendicular to the teeth 2.

In use, the weaver grasps handle 18 in one hand and inserts teeth 2 into the spaces between the warp yarns 20 (see FIG. 1) supported in a loom 22. The reed is then thrust downwardly to beat up the filling yarns 24 against the fell 26 of the fabric. This action is repeated across the entire width of the fabric until the filling yarns 24 are densely packed against the fell 26 of the fabric. It is to be understood in the context of this application that the term "fabric" encompasses a woven structure of any tupe, including textile cloth and oriental rugs.

The weight and size of the reed, and the comfortable orientation of handle 18 enable the reed to function much like a hammer in compacting the fillng yarns 24. This is readily accomplished by a single hand and does not require great strength because the reed is neither cumbersome nor exceedingly heavy, but has sufficient mass to compact the filling yarns when thrust downwardly by virture of its momentum. Teeth 2 are easily inserted between warp threads 20 because of their tapered tips 9, rounded edges and limited number as compared to very long combs or reeds of the prior art.

It will be obvious to one of ordinary skill that numerous modifications may be made without departing from the true spirit and scope of the invention which is to be limited only by the appended claims. For example, it is contemplated that the reed according to the invention may be made in other sizes or have different proportions, and the various components may be made of materials other than those specified for the preferred embodiment. Teeth 2 and spacers 4 could be laminated together using an adhesive, rather than rivets. Teeth 2, spacers 4 and grip portions 14 could be made of plastic, as long as the entire reed is properly weighted. The teeth, spacers and handle could even be integrally molded of a single material. Any handle configuration may be used as long as the grip portion of the handle extends transversely of the width W of the reed and transversely of the direction P in which the teeth project.

I claim:

1. For use in making a woven fabric having filling yarns joined to spaced warp yarns, a hand-held weaver's reed for beating up the filling yarns against the fell of the fabric comprising:

teeth support means;

a plurality of spaced, side-by-side, substantially parallel teeth secured to and projecting from said support means across the width of said support means, the spacing of said teeth approximating the spacing of the warp yarns of the fabric so that said teeth can be inserted between adjacent warp yarns to compress the filling yarns; and a handle secured to said support means and having an elongated grip portion which extends transversely of the width of said support means and transversely of the direction in which said teeth project from said support means, wherein said support means comprises a portion of the length of each of said teeth, a spacer between each pair of adjacent teeth alongside said length portion, and securing means for securing said teeth and said spacers together to form a laminated support structure for said teeth.

2. A weaver's reed according to claim 1 wherein said handle comprises an extension of one of said spacers.

3. A weaver's reed according to claim 2 wherein the spacer having said extension is centrally located with respect to the width of said support means.

4. A weaver's reed according to claim 2 where said grip portion of said handle comprises a grip member secured to said spacer extension, said grip member having a surface contoured for comfortable gripping by the user's hand.

5. A weaver's reed according to claim 1 wherein said securing means comprises at least one elongated member extending across the width of said support means through aligned holes in said teeth and in said spacers and engaging the end teeth to clamp said teeth and said spacers together.

6. A weaver's reed according to claim 1 weighing between one half and two pounds.

7. A weaver's reed according to claim 1 wherein the tips of said teeth are rounded to facilitate their insertion between the warp yarns.

8. For use in making a woven fabric having filling yarns to spaced warp yarns, a hand-held weaver's reed for beating up the filling yarns against the fell of the fabric comprising:

teeth support means;

a plurality of spaced, side-by-side, substantially parallel teeth secured to and projecting from said support means across the width of said support means, the spacing of said teeth approximating the spacing of the warp yarns of the fabric so that said teeth can be inserted between adjacent warp yarns to compress the filling yarns; and a handle secured to said support means and having an elongated grip portion which extends transversely of the width of said support means and transversely of the direction in which said teeth project from said support means, wherein said teeth and said support means are adapted to support the reed at rest on a supporting surface with said grip portion extending generally upwardly from said support means for easy grasping by the weaver.

9. A weaver's reed according to claim 8 wherein the portions of said support means and said teeth which support the reed at rest are substantially flat.

10. A weaver's reed according to claim 8 weighing between one half and two pounds.

11. A weaver's reed according to claim 8 wherein the tips of said teeth are rounded to facilitate their insertion between the warp yarns.

* * * * *